US008573769B2

(12) United States Patent
Tanaka et al.

(10) Patent No.: US 8,573,769 B2
(45) Date of Patent: Nov. 5, 2013

(54) IMAGE FORMING APPARATUS

(75) Inventors: Akiyoshi Tanaka, Kanagawa (JP); Yoichi Ito, Tokyo (JP); Kuniyori Takano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 23 days.

(21) Appl. No.: 13/238,034

(22) Filed: Sep. 21, 2011

(65) Prior Publication Data

US 2012/0081487 A1 Apr. 5, 2012

(30) Foreign Application Priority Data

Sep. 30, 2010 (JP) ..... 2010-222389

(51) Int. Cl.
*B41J 2/01* (2006.01)

(52) U.S. Cl.
USPC ..... 347/104; 347/101

(58) Field of Classification Search
None
See application file for complete search history.

(56) References Cited

U.S. PATENT DOCUMENTS

| | | | | |
|---|---|---|---|---|
| 4,861,013 | A * | 8/1989 | Shibata et al. | 271/119 |
| 5,172,238 | A * | 12/1992 | Kuboki | 358/296 |
| 5,761,565 | A * | 6/1998 | Baker et al. | 399/2 |
| 5,974,283 | A * | 10/1999 | Cho | 399/75 |
| 6,341,777 | B1 * | 1/2002 | Carter | 271/291 |
| 6,776,408 | B2 * | 8/2004 | Suzuki et al. | 271/188 |
| 6,918,585 | B2 * | 7/2005 | Ahn | 271/186 |
| 7,099,603 | B2 * | 8/2006 | Kimura et al. | 399/82 |
| 7,657,219 | B2 * | 2/2010 | Taniguchi et al. | 399/381 |
| 7,748,711 | B2 * | 7/2010 | Kawashima | 271/291 |
| 8,123,348 | B2 * | 2/2012 | Igi et al. | 347/102 |
| 8,137,014 | B2 * | 3/2012 | Wang et al. | 400/188 |
| 8,277,041 | B2 * | 10/2012 | Yamamoto | 347/104 |
| 2003/0179272 | A1 * | 9/2003 | Saito et al. | 347/104 |
| 2003/0209852 | A1 * | 11/2003 | Choi | 271/291 |
| 2004/0061761 | A1 * | 4/2004 | Ogura et al. | 347/104 |
| 2006/0093420 | A1 * | 5/2006 | Oba | 399/405 |
| 2008/0150227 | A1 * | 6/2008 | Hirokawa et al. | 271/265.01 |
| 2008/0239053 | A1 * | 10/2008 | Sakano | 347/104 |
| 2008/0298874 | A1 * | 12/2008 | Yoon | 400/642 |
| 2011/0141181 | A1 | 6/2011 | Ito et al. | |

FOREIGN PATENT DOCUMENTS

| | | | |
|---|---|---|---|
| JP | 05112044 | A * | 5/1993 |
| JP | 3366501 | | 11/2002 |
| JP | 3530675 | | 3/2004 |
| JP | 3629870 | | 12/2004 |

OTHER PUBLICATIONS

U.S. Appl. No. 13/224,436 of Yuji Tanaka et al., filed Sep. 2, 2011.

* cited by examiner

*Primary Examiner* — Stephen Meier
*Assistant Examiner* — Leonard S Liang
(74) *Attorney, Agent, or Firm* — Cooper & Dunham LLP

(57) ABSTRACT

An image forming apparatus including a conveyance unit to intermittently convey a recording medium in a conveyance direction, a carriage movable in a main scanning direction and including a recording head, a conveyance path having a curved portion provided downstream from an imaging range of the recording head, a first discharge member provided downstream from the imaging range to discharge the recording medium, and a second discharge member provided downstream from the first discharge member and having a nip to sandwich the recording medium to discharge the recording medium. A length of the conveyance path extending from a downstream edge of the imaging range to the nip is longer than a maximum length of the recording medium usable in the image forming apparatus to prevent a leading edge of the recording medium from being sandwiched by the second discharge member when the carriage performs last scanning movement.

16 Claims, 5 Drawing Sheets

IMAGE FORMING APPARATUS

CROSS-REFERENCE TO RELATED APPLICATIONS

This patent specification is based on Japanese Patent Application No. 2010-222389, filed on Sep. 30, 2010, which is hereby incorporated by reference herein in its entirety.

BACKGROUND

1. Technical Field

This disclosure relates generally to an inkjet-type image forming apparatus, in which a recording head that ejects ink droplets onto a recording medium is moved in a main scanning direction perpendicular to a direction of conveyance of the recording medium to form an image on the recording medium while the recording medium is intermittently conveyed.

2. Description of the Background Art

In an inkjet-type image forming apparatus such as an inkjet printer, a recording head scans in a main scanning direction and ejects ink droplets onto a recording medium such as a sheet of paper to form an image on the sheet while the sheet is intermittently conveyed in a sub-scanning direction perpendicular to the main scanning direction.

Accuracy in conveyance of the sheet affects image quality in the inkjet-type image forming apparatus. Therefore, a pair of discharge rollers that discharges the sheet from the image forming apparatus is required to exert just enough conveyance force to reliably convey and discharge the sheet without affecting conveyance accuracy.

In addition, it takes time to dry the ink ejected onto the sheet. Therefore, a discharge roller serving as a drive roller that constitutes one of the pair of discharge rollers is generally disposed on a side opposite the side of the sheet on which the image is formed (hereinafter the "image formation side" of the sheet). By contrast, a spur that contacts the discharge roller and is driven by the discharge roller is generally provided on the same side as the image formation side of the sheet. Consequently, contact pressure of the spur against the discharge roller is minimized in order to prevent deterioration in image quality.

In a case in which a reversal unit that reverses the sheet during duplex image formation is provided downstream from an imaging range of the recording head in a direction of conveyance of the sheet, the image forming apparatus is generally further provided with a curved conveyance path through which the sheet is conveyed. The direction of conveyance of the sheet is changed through the curved conveyance path, such that the sheet having an image on a front side thereof is either discharged from the image forming apparatus or is reversed to form an image on a back side thereof. When the sheet passes through the curved conveyance path, conveyance resistance of the sheet is increased. Therefore, it is necessary to increase the conveyance force of the pair of discharge rollers, by increasing the contact pressure of the spur against the discharge roller. Although an increase in the contact pressure of the spur against the discharge roller increases the conveyance force of the pair of discharge rollers, it also degrades image quality. In addition, an increase in the conveyance force adversely affects accuracy in conveyance of the sheet.

Some image forming apparatuses have two pairs of discharge rollers to increase the total conveyance force of the pairs of discharge rollers without changing a conveyance force per pair of discharge rollers. For the purpose of stabilizing a trailing edge of the sheet after the sheet passes through a pressing roller, the first pair of discharge rollers is provided downstream from a recording unit in a direction of conveyance of a sheet and the second pair of discharge rollers is provided downstream from the first pair of discharge rollers. The first pair of discharge rollers biases the trailing edge of the sheet in a direction to separate the sheet from the recording unit so as to discharge the sheet from the image forming apparatus.

In another approach, the image is formed on the sheet while the sheet is conveyed horizontally. The axial center of an upper roller constituting one of the second pair of discharge rollers is displaced in the direction of conveyance of the sheet from the axial center of a lower roller constituting the other one of the second pair of discharge rollers so as to prevent deterioration in image quality.

However, in the above-described configurations in which the two pairs of discharge rollers are provided so as to increase the total conveyance force of the pairs of discharge rollers, the sheet is pulled by the conveyance force of the second pair of discharge rollers when a leading edge of the sheet is sandwiched by the second pair of discharge rollers either while or before the last line of the image is being formed on the sheet by the recording unit, thus adversely affecting sheet conveyance accuracy.

SUMMARY

This disclosure provides a novel inkjet-type image forming apparatus including two pairs of discharge rollers that improves conveyance of a recording medium without degrading accuracy in conveyance of the recording medium.

In one illustrative embodiment, an image forming apparatus includes: a conveyance unit to intermittently convey a recording medium in a conveyance direction; a carriage movable in a main scanning direction perpendicular to the conveyance direction and including a recording head to eject ink onto the recording medium; a conveyance path having a curved portion provided downstream from an imaging range of the recording head in the conveyance direction, the curved portion of the conveyance path changing the conveyance direction of the recording medium onto which an image is formed by the recording head; a first discharge member provided downstream from the imaging range of the recording head in the conveyance direction to discharge the recording medium having the image thereon; and a second discharge member provided downstream from the first discharge member in the conveyance direction, the second discharge member having a nip to sandwich the recording medium so as to discharge the recording medium having the image thereon. A length of the conveyance path extending from a downstream edge of the imaging range of the recording head in the conveyance direction to the nip of the second discharge member is longer than a maximum length of the recording medium usable in the image forming apparatus in the conveyance direction so as to prevent a leading edge of the recording medium from being sandwiched by the second discharge member in the nip when the carriage performs last scanning movement for image formation of a last line on the recording medium.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF ILLUSTRATIVE EMBODIMENTS

Figure 1:
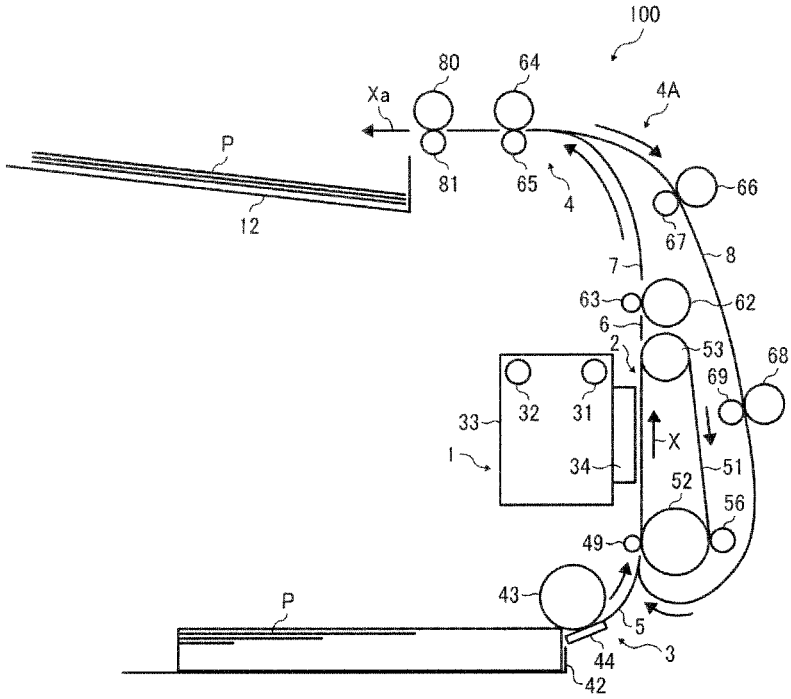
FIG. 1 is a schematic view illustrating an example of a configuration of an image forming apparatus according to an illustrative embodiment.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

A configuration and operation of a serial-type image forming apparatus 100 employing an inkjet method according to an illustrative embodiment is described in detail below, with reference to FIG. 1. FIG. 1 is a schematic view illustrating an example of a configuration of the image forming apparatus 100 according to the illustrative embodiment.

The image forming apparatus 100 includes an image forming unit 1 that performs image formation using the inkjet method, a conveyance unit 2 that conveys a sheet P serving as a recording medium, a sheet feeder 3 that feeds the sheet P, and a discharge/reversal unit 4 including a discharge part and a reversal area 4A. The discharge part discharges the sheet P having an image thereon from the image forming apparatus 100, and in the reversal area 4A there is a change in a direction of conveyance of the sheet P having an image on a front side thereof to reverse the sheet P for duplex image formation.

The sheet P fed from the sheet feeder 3 is conveyed to the conveyance unit 2 via a sheet feed path 5. The sheet feed path 5 is connected to a common conveyance path 6 through which the sheet P having an image on the front side or both sides thereof is conveyed to a downstream side from the image forming unit 1 in the direction of conveyance of the sheet P. The common conveyance path 6 is further connected to a curved conveyance path 7 in which the direction of conveyance of the sheet P is changed. The sheet P having the image on the front side thereof is reversed to be conveyed to the image forming unit 1 and the conveyance unit 2 again through a reversal conveyance path 8 during duplex image formation. The reversal conveyance path 8 is provided in the reversal area 4A and is connected to the curved conveyance path 7.

The image forming unit 1 includes a carriage 33 reciprocally movable back and forth in a main scanning direction, that is, a direction perpendicular to the plane of the sheet of paper on which FIG. 1 is drawn. The carriage 33 is slidably held in the main scanning direction by a main guide rod 31 and a parallel sub-guide rod 32 extending between lateral plates of the image forming apparatus 100. A main scanning motor coupled to the carriage 33 via a timing belt, not shown, moves the carriages 33 in the main scanning direction.

A recording head 34 constituted of a liquid ejection head that ejects ink droplets of a specific color, that is, yellow (Y), cyan (C), magenta (M), or black (K), is installed on the carriage 33. Four nozzle arrays each constituted of multiple nozzles are formed in a sub-scanning direction X in the recording head 34 to eject ink droplets of the specified colors in a horizontal direction. It is to be noted that the sub-scanning direction corresponds to the direction of conveyance of the sheet P, and is perpendicular to the main scanning direction of the carriage 33.

A head tank, not shown, is installed in the carriage 33 to supply ink of the specified colors to the corresponding nozzle arrays in the recording head 34. The ink is supplied from ink cartridges for the specified colors detachably attached to a cartridge loading unit, not shown, to the head tank through supply tubes by a supply pump unit.

The sheet feeder 3 includes a sheet feed tray 42 that stores a stack of multiple sheets P, a sheet feed roller 43 that feeds the sheet P in the sheet feed tray 42, and a separation pad 44 that separates the stack of multiple sheets P one by one together with the sheet feed roller 43. The separation pad 44 is disposed opposite the sheet feed roller 43 to be pressed against the sheet feed roller 43, and is formed of a material having a larger frictional factor.

The conveyance unit 2 conveys the sheet P fed from the sheet feeder 3 or the sheet P conveyed backward from the reversal area 4A during duplex image formation to the image forming unit 1 provided opposite the recording head 34. The conveyance unit 2 includes a pressing roller 49, a conveyance belt 51, and a charging roller 56. The pressing roller 49 presses the conveyance belt 51 from a top surface of the conveyance belt 51.

The conveyance belt 51 electrostatically attracts the sheet P fed from the sheet feeder 3 and intermittently conveys the sheet P in the sub-scanning direction X (or the direction of conveyance of the sheet P) to the recording head 34. The conveyance belt 51 is formed of a seamless belt and is wound around a conveyance roller 52 and a tension roller 53 to be rotated in the sub-scanning direction X. The charging roller 56 contacts a top layer (an insulative layer) of the conveyance belt 51 and is rotated by the rotation of the conveyance belt 51 to charge the conveyance belt 51. The conveyance roller 52 is rotated by a sub-scanning motor via a timing belt serving as a transmission member, not shown, and the rotation of the conveyance roller 52 rotates the conveyance belt 51.

The conveyance belt 51 is constituted of either a single layer or, as in the present embodiment, multiple layers. At least the top layer of the conveyance belt 51 which contacts the sheet P and the charging roller 56 is constituted of an insulative layer formed of a resin such as PET, PEI, PVDF, PC, ETFE, and PTFE, or an elastomer without a conductivity control agent. When constituted of multiple layers, the conveyance belt 51 may have a conductive layer on a surface thereof which does not contact the charging roller 56. Such a conductive layer may be formed of the above-described resin or an elastomer, each containing carbon.

Positive and negative voltages are applied alternately to the charging roller 56, that is, an alternating voltage is applied to the charging roller 56, from a voltage applicator, not shown, so that the conveyance belt 51 is charged in a pattern of alternating voltages, that is, the conveyance belt 51 is alternately charged to positive and negative voltages of a predetermined extent in the direction of rotation of the conveyance belt 51 or the sub-scanning direction X. Accordingly, the sheet P conveyed to the conveyance belt 51 thus alternately charged to the positive and negative voltages is electrostatically attracted to the conveyance belt 51 and is further conveyed in the sub-scanning direction X by the rotation of the conveyance belt 51.

The recording head 34 is driven based on image signals under the control of a control unit, not shown, while the carriage 33 is moved so that ink droplets are ejected from the recording head 34 to the sheet P, which remains stationary, to form a single line in an image to be formed on the sheet P. Thereafter, the conveyance belt 51 conveys the sheet P forward by a predetermined amount to perform image formation of the next line. When the control unit receives a completion signal or a signal which indicates that a trailing edge of the sheet P has passed an imaging range 10 of the recording head 34, image formation is completed and that the sheet P is discharged to a discharge tray 12.

The image forming apparatus 100 further includes a conveyance roller 62 and a spur 63 each serving as a discharge member that discharges the sheet P onto which the image is formed by the recording head 34. The conveyance roller 62 and the spur 63 together convey the sheet P separated from the conveyance belt 51 to the discharge/reversal unit 4. A nip is formed between the conveyance roller 62 and the spur 63 on a line extending from a plane of the conveyance belt 51 such that entrance of a leading edge of the sheet P having the image thereon in the nip does not affect accuracy in image formation on the sheet P performed by the recording head 34. In addition, both the conveyance roller 62 and the spur 63 have a conveyance force sufficient to completely discharge the sheet P to the curved conveyance path 7 without affecting accuracy in image formation on the sheet P performed by the recording head 34. As a result, the trailing edge of the sheet P sandwiched by the conveyance roller 62 and the spur 63 does not remain at the nip between the conveyance roller 62 and the spur 63.

The discharge/reversal unit 4 includes a first discharge roller 64 and a first discharge spur 65 (hereinafter also collectively referred to as a first pair of discharge rollers 64 and 65) and a second discharge roller 80 and a second discharge spur 81 (hereinafter also collectively referred to as a second pair of discharge rollers 80 and 81) provided downstream from the first pair of discharge rollers 64 and 65 in the direction of conveyance of the sheet P. The first pair of discharge rollers 64 and 65 serving as a first discharge member and the second pair of the discharge rollers 80 and 81 serving as a second discharge member are rotatable both in clockwise and counterclockwise directions.

The discharge tray 12 on which the sheet P discharged by the second pair of discharge rollers 80 and 81 is stacked is provided on the extreme downstream side in a direction of discharge of the sheet P (hereinafter also referred to a sheet discharge direction Xa).

A hinged changeover member such as a changeover pick is provided where the curved conveyance path 7 and the reversal conveyance path 8 in the discharge/reversal unit 4 branch. A first reversal roller 66, a first reversal spur 67, a second reversal roller 68, and a second reversal spur 69 are provided along the reversal conveyance path 8 to convey the sheet P having the image on the front side thereof during duplex image formation. The sheet P conveyed through the reversal conveyance path 8 is conveyed between the conveyance belt 51 and the pressing roller 49 again by the second reversal roller 68 and the second reversal spur 69.

Figure 2:
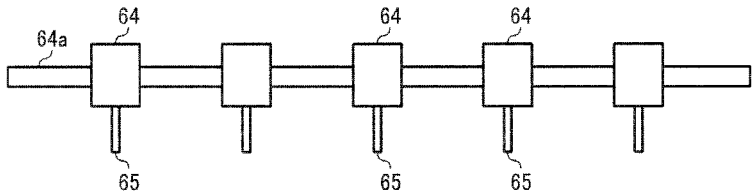
FIG. 2 is a plan view illustrating a configuration of a first pair of discharge rollers.

A description is now given of a configuration of the first pair of discharge rollers 64 and 65 with reference to FIG. 2. FIG. 2 is a plan view illustrating the configuration of the first pair of discharge rollers 64 and 65. The first discharge roller 64 is constituted of multiple individual rollers fixed to a discharge roller shaft 64*a*, and is formed of EPDM rubber. The first discharge spur 65 is formed of sheet metal such as stainless steel and contacts the first discharge roller 64 to form a nip at which the sheet P is sandwiched by the first pair of discharge rollers 64 and 65. The first pair of discharge rollers 64 and 65 is provided with a conveyance force to convey the sheet P.

A configuration of the second pair of discharge rollers 80 and 81 is the same as that of the first pair of discharge rollers 64 and 65 described above, and therefore, a description thereof is omitted.

Figure 3:
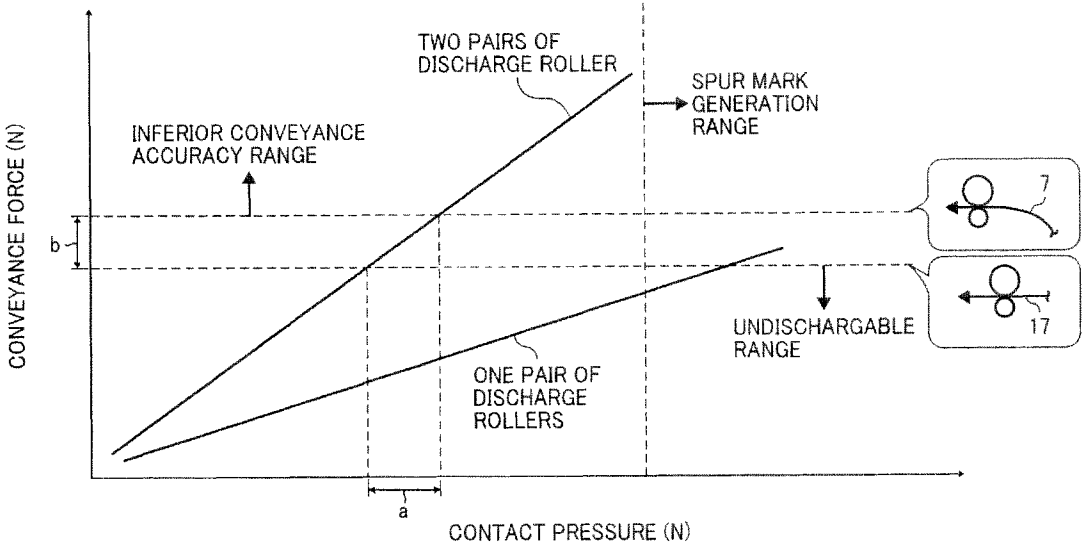
FIG. 3 is a graph showing a relation between a conveyance force of a discharge roller and a contact pressure of a spur against the discharge roller.

FIG. 3 is a graph showing a relation between the conveyance force of the pair of discharge rollers and the contact pressure from the discharge spur against the discharge roller. In FIG. 3, the horizontal axis represents the contact pressure from the discharge spur against the discharge roller, and the vertical axis represents an amount of conveyance force of the pair of discharge rollers. In the graph shown in FIG. 3, the lower sloping line represents a result obtained when a single pair of discharge rollers is provided, and the upper sloping line represents a result obtained when two pairs of discharge rollers are provided in a manner similar to the configuration of the image forming apparatus 100 illustrated in FIG. 1. As can be seen from FIG. 3, a conveyance force sufficient for conveyance and discharge of the sheet P cannot be obtained by provision of the single pair of discharge rollers. However, as is also clear from FIG. 3, even when an amount of contact pressure from the discharge spur against the discharge roller is the same as that in the configuration having the single pair of discharge rollers, a conveyance force that sufficiently conveys and discharges the sheet P can be obtained when the two pairs of discharge rollers are provided.

It is to be noted that, in the graph shown in FIG. 3, the upper horizontal broken line represents the acceptable limit of accuracy in conveyance of the sheet P when the single pair of discharge rollers is provided downstream from the curved conveyance path 7 as shown in the upper illustration in FIG. 3. By contrast, the lower horizontal broken line represents the acceptable limit of accuracy, in conveyance of the sheet P when the single pair of discharge rollers is provided downstream from a straight conveyance path 17, as illustrated in a lower blow-up in FIG. 3. It should be noted that the larger roller shown in both blow-ups in FIG. 3 represents the discharge roller and the smaller roller represents the discharge spur.

When the contact pressure from the discharge spur against the discharge roller is too large as indicated by a spur mark generation range in FIG. 3, holes may be formed in the sheet P due to multiple fine protrusions formed on an outer surface of the discharge spur. In addition, when the conveyance force of the pair of discharge rollers is too large as indicated by an inferior conveyance accuracy range in FIG. 3, the pair of discharge rollers pulls the sheet P too much, thereby adversely affecting accuracy in conveyance of the sheet P performed by the conveyance belt 51 and displacing landing positions of ink droplets ejected from the recording head 34 onto the sheet P. Further, in an undischargable range in FIG. 3, the trailing edge of the sheet P is not discharged and remains between the discharge roller and the discharge spur when the sheet P has stiffness.

Therefore, it is preferable that the contact pressure from the discharge spur against the discharge roller be set within a range a shown in FIG. 3 and the conveyance force be set within a range b shown in FIG. 3. As a result, the sheet P which has passed through the curved conveyance path 7 is not pulled by the first pair of discharge rollers 64 and 65, so that the conveyance belt 51 accurately conveys the sheet P. In addition, the trailing edge of the sheet P does not remain between the second pair of discharge rollers 80 and 81, so that the sheet P is completely discharged to the discharge tray 12. Further, formation of the holes on the sheet P due to multiple fine protrusions formed on the outer surface of the discharge spur can be prevented.

Figure 4:
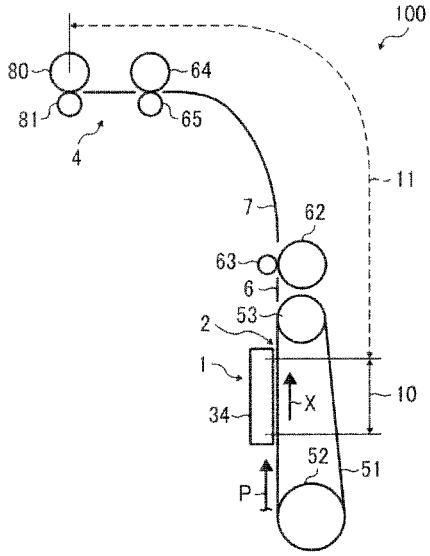
FIG. 4 is a schematic view illustrating an example of a configuration of main components in the image forming apparatus according to the illustrative embodiment.

A configuration of the main components of the image forming apparatus 100 according to the illustrative embodiment is described in detail below with reference to FIG. 4. FIG. 4 is a schematic view illustrating a configuration of the main components of the image forming apparatus 100 according to the illustrative embodiment. As described above, the nozzle arrays that eject ink droplets are formed in the recording head 34. A length of each of the nozzle arrays corresponds to the imaging range 10 of the recording head 34 in the sub-scanning direction X. A conveyance path length 11 from a downstream edge of the imaging range 10 in the sub-scanning direction X to the center of the nip between the second pair of discharge rollers 80 and 81 is set to be larger than the maximum available length of the sheet P used in the image forming apparatus 100.

Strictly speaking, the conveyance path length 11 is set to be longer than the maximum available length of the sheet P used in the image forming apparatus 100 in the sub-scanning direction X, to prevent the leading edge of the sheet P from being sandwiched by the second pair of discharge rollers 80 and 81 when the recording head 34 performs the last scanning movement for image formation of the last line on the sheet P.

As a result, the sheet P is not conveyed by the first and second discharge rollers 64, 65, 80, and 81 in the discharge/reversal unit 4 during image formation performed by the recording head 34. Conveyance of the sheet P by the second pair of discharge rollers 80 and 81 is started after the trailing edge of the sheet P passes the imaging range 10, thereby improving the conveyance force in the discharge/reversal unit 4 without adversely affecting accuracy in conveyance of the sheet P.

A load on conveyance of the sheet P in the discharge/reversal unit 4 varies depending on a shape and curvature of the curved conveyance path 7; specifically, the smaller the radius of curvature and the reversal diameter, the larger the load on conveyance of the sheet P. Therefore, it is necessary to increase the conveyance force in the discharge/reversal unit 4 in order to reliably convey and completely discharge the sheet P. However, as described previously, too much increase in the conveyance force adversely affects accuracy in conveyance of the sheet P. Because the conveyance path length 11 is set to be longer than the maximum available length of the sheet P used in the image forming apparatus 100, an increase in only the conveyance force of the second pair of discharge rollers 80 and 81 achieves accurate conveyance and complete discharge of the sheet P without adversely affecting accuracy in conveyance of the sheet P. As a result, the conveyance force can be increased regardless of the load on conveyance of the sheet P in the discharge/reversal unit 4.

The conveyance force of the second pair of discharge rollers 80 and 81 varies depending on a drive force of a motor or the like that drives the second discharge roller 80, as well as on the number of individual rollers that constitute the second discharge roller 80, a frictional factor of the discharge roller 80, and the number of spurs that constitute the second discharge spur 81 pressed against the second discharge roller 80. Accordingly, an increase in the number of rollers that constitute the second discharge roller 80, the frictional factor of the second discharge roller 80, or the number of spurs that constitute the second discharge spur 81 increases the conveyance force of the second pair of discharge rollers 80 and 81.

Thus, the second pair of discharge rollers 80 and 81 by itself has sufficient conveyance force to reliably convey and completely discharge the sheet P, while the first discharge rollers 64 and 65 convey the sheet P having the image thereon to the second pair of discharge rollers 80 and 81 and support conveyance performance of the second pair of discharge rollers 80 and 81.

Returning to FIG. 1, operations of the image forming apparatus 100 according to the present illustrative embodiment are described in detail below.

During simplex image formation in which an image is formed only on the front side of the sheet P, when the image forming apparatus 100 is turned on and number of sheets P on which images are to be formed, magnification of the images, and so forth are set through keys provided to an operation unit, not shown, the sheet feeder 3 is activated in synchronization with the image forming unit 1 and the conveyance unit 2 by an instruction from the control unit that controls operations of the image forming apparatus 100. Accordingly, the sheets P fed one by one from the sheet feed tray 42 by the sheet feed roller 43 and the separation pad 44 are conveyed between the pressing roller 49 and the conveyance belt 51 in the conveyance unit 2 through a guide member, not shown.

The conveyance belt 51 is rotated in the sub-scanning direction X by the rotation of the conveyance roller 52 driven by the sub-scanning motor. The charging roller 56 contacting the top layer of the conveyance belt 51 is rotated by the rotation of the conveyance belt 51. At this time, an alternating voltage is applied to the charging roller 56 from the voltage applicator, so that the conveyance belt 51 is alternately charged by positive and negative voltages of predetermined extent. Accordingly, the sheet P conveyed to the conveyance belt 51 thus alternately charged to the positive and negative voltages is electrostatically attracted to the conveyance belt 51 and is further conveyed in the sub-scanning direction X by the rotation of the conveyance belt 51. Then, conveyance of the sheet P is temporarily stopped at the imaging range 10.

The recording head 34 is driven based on image signals while the carriage 33 is moved in the main scanning direction so that ink droplets are ejected from the recording head 34 onto the sheet P, which remains stationary, to form a single line in an image to be formed on the sheet P. Thereafter, the sheet P is conveyed by a predetermined amount by the conveyance belt 51 to perform image formation of the next line.

The sheet P is further conveyed by the conveyance belt 51 and the rotation of the conveyance roller 62. At this time, the sheet P having the image on the front side thereof is separated from the conveyance belt 51 by a hinged separation pick provided between the tension roller 53 and the conveyance roller 62. The sheet P is then conveyed to the curved conveyance path 7 in the discharge/reversal unit 4 by the spur 63 driven by the conveyance roller 62. A conveyance guide member provided along the curved conveyance path 7 guides the sheet P so that the sheet P is conveyed to the downstream side.

The sheet P is further conveyed in the sheet discharge direction Xa by the first pair of discharge rollers 64 and 65 and the second pair of discharge rollers 80 and 81 provided downstream from the first pair of discharge rollers 64 and 65. At this time, the conveyance path length 11 is set to be longer than the maximum available length of the sheet P used in the image forming apparatus 100 in the sub-scanning direction X, to prevent the leading edge of the sheet P from being sandwiched by the second pair of discharge rollers 80 and 81 when the recording head 34 performs the last scanning movement for image formation of the last line on the sheet P. Accordingly, after the completion of image formation of the last line by the recording head 34, the leading edge of the sheet P reaches the nip between the second pair of discharge rollers 80 and 81 so that the sheet P is conveyed by both the first and second pairs of discharge rollers 64, 65, 80 and 81. As a result, the conveyance force to convey the sheet P is increased while achieving accuracy in conveyance of the sheet P in the configuration including the two pairs of discharge rollers 64, 65, 80, and 81.

When the control unit receives a completion signal or a signal which indicates that the trailing edge of the sheet P has passed the imaging range 10 of the recording head 34, image formation is completed and the sheet P is discharged to the discharge tray 12.

A description is now given of operations of the image forming apparatus 100 during duplex image formation, in which images are formed on both sides of the sheet P.

After the image is formed on the front side of the sheet P as described above, the sheet P is guided between the first pair of discharge rollers 64 and 65. When a sensor, not shown, detects that the trailing edge of the sheet P has passed a branching portion in the sheet discharge/reversal unit 4, the first and second discharge rollers 64 and 80 are reversely driven to convey the sheet P backward. At this time, the direction of conveyance of the sheet P is switched by the changeover member provided at the branching portion between the curved conveyance path 7 and the reversal conveyance path 8 in the discharge/reversal unit 4, so that the sheet P is conveyed to the reversal conveyance path 8. When a sensor for detecting switchback of the sheet P detects the leading edge of the sheet P (which corresponds to the trailing edge of the sheet P before the direction of conveyance of the sheet P is changed), the sheet P is conveyed downward through the reversal conveyance path 8.

The pair of reversal rollers 66 and 67 conveys the sheet P downward through the reversal conveyance path 8 to the portion between the pressing roller 49 and the drive roller 52. Then, the sheet P is attracted to the conveyance belt 51 again to be conveyed to the imaging range 10 by the conveyance belt 51. Thereafter, an image is formed on the back side of the sheet P in a manner similar to the simplex image formation described above.

Figure 5:
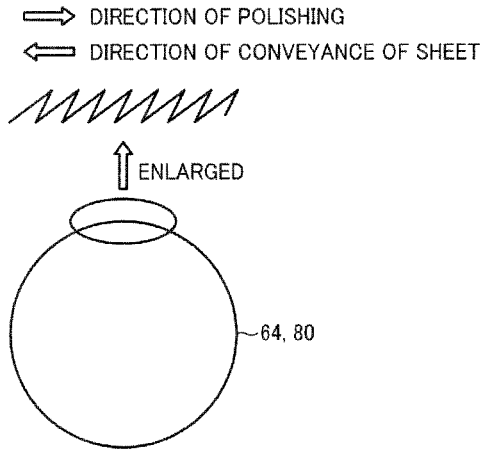
FIG. 5 is an enlarged schematic view illustrating an example of an outer circumferential surface of a discharge roller for explaining a first variation of the illustrative embodiment.

A description is now given of a first variation of the present illustrative embodiment with reference to FIG. 5. FIG. 5 is an enlarged schematic view illustrating an example of an outer circumferential surface of the first or second discharge roller 64 or 80 for explaining the first variation. In general, an outer circumferential surface of each of the first and second discharge rollers 64 and 80 is polished to achieve a constant uniform outer diameter from one roller to the next and obtain a constant frictional factor relative to the sheet P. Typically, the direction of conveyance of the sheet P is the reverse of the direction of polishing of the first and second discharge rollers 64 and 80 as illustrated in FIG. 5, because when the direction of conveyance of the sheet P is set the same as a direction of polishing of the first and second discharge rollers 64 and 80 the polished surface of each of the discharge rollers 64 and 80 bristles, thereby destabilizing the frictional factor. However, although a constant frictional factor is not obtained, the frictional factor itself is increased when the polished surfaces of the first and second discharge rollers 64 and 80 bristle. As a result, the conveyance force of each of the first and second discharge rollers 64 and 80 is also increased.

An increase in the number of rollers that constitute each of the first and second discharge rollers 64 and 80 or the number of spurs that constitute each of the first and second discharge spurs 65 and 81 and use of the first and second discharge rollers 64 and 80 each having a different frictional factor increase production costs. Therefore, in the first variation, the outer circumferential surface of the first discharge roller 64 is polished in the same direction as the direction of conveyance of the sheet P, while the outer circumferential surface of the second discharge roller 80 is polished in the direction opposite the direction of conveyance of the sheet P. As a result, the conveyance force of the second pair of discharge rollers 80 and 81 is increased in the configuration having the two pairs of discharge rollers 64, 65, 80, and 81.

Figure 6A:
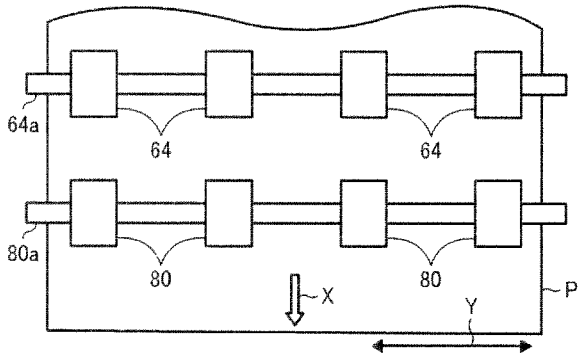
FIG. 6A is a plan view illustrating disposition of discharge rollers according to a comparative example of a second variation of the illustrative embodiment.
Figure 6B:
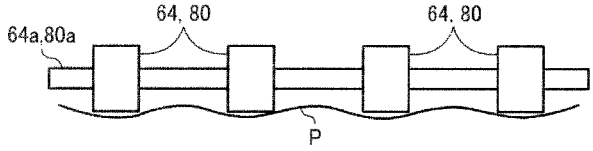
FIG. 6B is a side view illustrating the disposition of the discharge rollers illustrated in FIG. 6A viewed from a downstream side in a direction of conveyance of a recording medium.
Figure 6C:
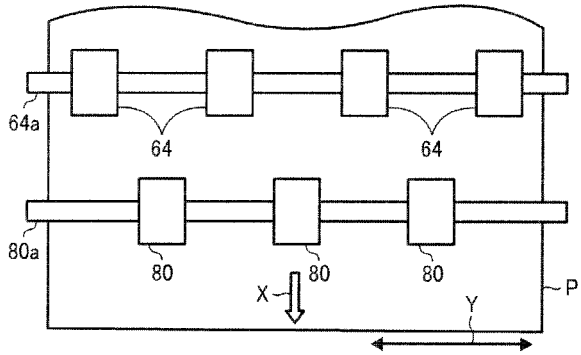
FIG. 6C is a plan view illustrating disposition of discharge rollers according to the second variation of the illustrative embodiment.
Figure 6D:
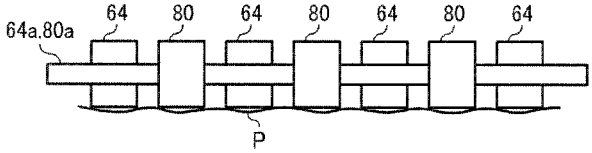
FIG. 6D is a side view illustrating the disposition of the discharge rollers illustrated in FIG. 6C viewed from the downstream side.

A description is now given of a second variation of the present illustrative embodiment with reference to FIGS. 6A to 6D. FIG. 6A is a plan view illustrating disposition of the first and second discharge rollers 64 and 80 according to a comparative example of the second variation. FIG. 6B is a side view illustrating the disposition of the first and second discharge rollers 64 and 80 illustrated in FIG. 6A viewed from the downstream side. FIG. 6C is a plan view illustrating disposition of the first and second discharge rollers 64 and 80 according to the second variation of the present illustrative embodiment. FIG. 6D is a side view illustrating the disposition of the first and second discharge rollers 64 and 80 illustrated in FIG. 6C viewed from the downstream side. It is to be noted that reference numeral 80*a* in FIGS. 6A to 6D denotes a discharge roller shaft to which multiple rollers that constitute the second discharge roller 80 are fixed.

In the image forming unit 2, the sheet P becomes wavy due to moisture contained in the ink droplets ejected from the recording head 34. Consequently, an orientation of the sheet P on the way to being discharged becomes unstable, thereby preventing stable stacking of the sheet P on the discharge tray 12. In addition, in the image forming apparatus 100 further including a post-processing device such as a sorter, sheet jam may occur at a portion where the sheet P is received by the post processing device.

In order to prevent the above-described problems, in the second variation of the present illustrative embodiment, the rollers that constitute the first or second discharge roller 64 or 80 are alternately disposed in a width direction Y of the sheet P, that is, the main scanning direction of the carriage 33 perpendicular to the direction of conveyance of the sheet P (or the sub-scanning direction X). Accordingly, the orientation of the sheet P on the way to be discharged can be controlled, thereby preventing the sheet P from becoming wavy. As a result, the sheet P discharged from the image forming apparatus 100 can be reliably stacked on the discharge tray 12. Further, in the image forming apparatus 100 provided with the post-processing device, the sheet P is smoothly received by the post-processing device.

Figure 7A:
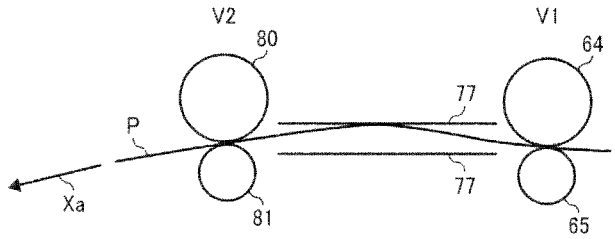
FIGS. 7A and 7B are vertical cross-sectional views respectively illustrating a posture of a recording medium conveyed by discharge rollers according to comparative examples of a third variation of the illustrative embodiment.
Figure 7B:
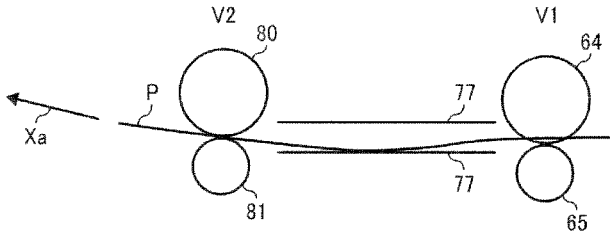
Figure 7C:
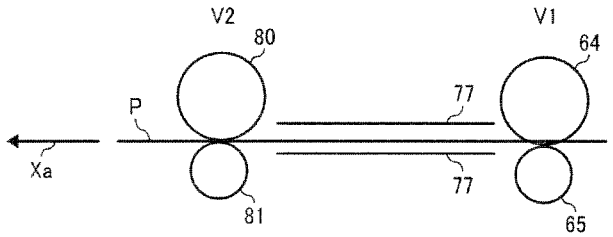
FIG. 7C is a vertical cross-sectional view illustrating a posture of a recording medium conveyed by discharge rollers according to the third variation of the illustrative embodiment.

A description is now given of a third variation of the present illustrative embodiment with reference to FIGS. 7A, 7B, and 7C. FIGS. 7A and 7B are vertical cross-sectional views respectively illustrating a posture of the sheet P conveyed by the first and second discharge rollers 64 and 80 according to comparative examples of the third variation. FIG. 7C is a vertical cross-sectional view illustrating a posture of the sheet P conveyed by the first and second discharge rollers 64 and 80 according to the third variation.

A conveyance speed v1 of the first pair of the discharge rollers 64 and 65 to convey the sheet P faster than a conveyance speed v2 of the second pair of discharge rollers 80 and 81 to convey the sheet P bends the sheet P between the first and second pairs of discharge rollers 64, 65, 80, and 81 as illustrated in FIGS. 7A and 7B. Consequently, a pair of guide plates 77 provided between the first pair of discharge rollers 64 and 65 and the second pair of discharge rollers 80 and 81 scratches the sheet P, thereby degrading image quality. In addition, the sheet discharge direction Xa may be changed depending on a direction of bending of the sheet P, thereby preventing stable discharge of the sheet P to the discharge tray 12.

In order to solve the above-described problems, in the third variation, the conveyance speed v2 of the second pair of discharge rollers 80 and 81 is set faster than the conveyance speed v1 of the first pair of discharge rollers 64 and 65 so as to prevent the sheet P from being bent between the first pair of the discharge rollers 64 and 65 and the second pair of discharge rollers 80 and 81 as illustrated in FIG. 7C. As a result, the sheet discharge direction Xa can be stabilized.

It is to be noted that a combination of the configurations according to the second and third variations can further stabilize discharge of the sheet P.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

It is to be noted that, a shape of the curved conveyance path 7 is not limited to a curved shape, but also includes a straight shape provided with a member or a mechanism that applies load such as a conveyance resistance to the sheet P so as to change the direction of conveyance of the sheet P.

The foregoing illustrative embodiment is also applicable to inkjet-type image forming apparatuses such as printers, copiers, plotters, facsimile machines, and multifunction devices having two or more of printing, copying, plotting, and facsimile functions.

The sheet P includes any types of sheets, from thin sheets to thick sheets, on which images are formed by the inkjet-type image forming apparatuses.

Although the conveyance unit 2 illustrated in FIG. 1 is extended vertically, alternatively, it may be extended horizontally. In such a configuration, the sheet P is discharged through the curved conveyance path 7 to the discharge tray 12 provided above or below the image forming unit 1.

What is claimed is:

1. An image forming apparatus comprising:

a conveyance unit to intermittently convey a recording medium in a conveyance direction;

a carriage movable in a main scanning direction perpendicular to the conveyance direction and including a recording head to eject ink onto the recording medium;

a conveyance path having a curved portion provided downstream from an imaging range of the recording head in the conveyance direction, the curved portion of the conveyance path changing the conveyance direction of the recording medium onto which an image is formed by the recording head;

a first discharge member configured to have a nip to sandwich the recording medium and provided downstream from the imaging range of the recording head in the conveyance direction to discharge the recording medium having the image thereon; and a second discharge member provided downstream from the first discharge member in the conveyance direction, the second discharge member having a nip to sandwich the recording medium so as to discharge the recording medium having the image thereon, wherein a length of the conveyance path extending from a downstream edge of the imaging range of the recording head in the conveyance direction to the nip of the second discharge member is longer than a maximum length of the recording medium usable in the image forming apparatus in the conveyance direction so as to prevent a leading edge of the recording medium from being sandwiched by the second discharge member in the nip when the carriage performs last scanning movement for image formation of a last line on the recording medium, and wherein both of the first discharge member and second discharge member are provided downstream in the conveyance direction from the curved portion of the conveyance path.

2. The image forming apparatus according to claim 1, further comprising a reversal unit continuous with the curved portion of the conveyance path in which the conveyance direction of the recording medium having the image on a front side thereof is reversed.

3. The image forming apparatus according to claim 1, wherein a conveyance force of the second discharge member is larger than a conveyance force of the first discharge member.

4. The image forming apparatus according to claim 1, wherein a frictional factor of the second discharge member against the recording medium is larger than a frictional factor of the first discharge member against the recording medium.

5. The image forming apparatus according to claim 1, wherein:

each of the first and second discharge members is constituted of multiple rollers aligned in the main scanning direction; and the first discharge member has more rollers aligned in the main scanning direction than the second discharge member.

6. The image forming apparatus according to claim 5, wherein each of the first and second discharge members further comprises multiple spurs provided opposite and parallel to the multiple rollers aligned in the main scanning direction and rotatably contacting the multiple rollers, wherein the first discharge member has more spurs than the second discharge member.

7. The image forming apparatus according to claim 1, wherein:

each of the first and second discharge members is constituted of multiple rollers;

a direction of polishing of an outer circumferential surface of each of the multiple rollers constituting the first discharge member provided downstream from the recording head in the conveyance direction is different from the conveyance direction; and a direction of polishing of an outer circumferential surface of each of the multiple rollers constituting the second discharge member provided downstream from the first discharge member in the conveyance direction is the same as the conveyance direction.

8. The image forming apparatus according to claim 1, wherein each of the first and second discharge members is constituted of multiple rollers, the rollers of the first and second discharge members alternately disposed in a width direction of the recording medium perpendicular to the conveyance direction, the rollers of the second discharge member being downstream from the rollers of the first discharge member.

9. The image forming apparatus according to claim 1, wherein a conveyance speed of the second discharge member is faster than a conveyance speed of the first discharge member.

10. The image forming apparatus according to claim 1, wherein the first discharge member guides the recording medium having the image thereon to the second discharge member and supplements a conveyance force of the second discharge member.

11. The image forming apparatus according to claim 1, wherein a portion of the conveyance path provided opposite the recording head in the imaging range extends substantially vertically within the image forming apparatus.

12. The image forming apparatus according to claim 1, wherein the curved portion of the conveyance path comprises a conveyance guide member.

13. The image forming apparatus according to claim 1, further comprising a third discharge member provided downstream from the imaging range of the recording head in the conveyance direction and upstream from the first discharge member, the third discharge member having a nip to sandwich the recording medium so as to discharge the recording medium having the image thereon.

14. The image forming apparatus according to claim 1, wherein a length of the conveyance path extending from the downstream edge of the imaging range of the recording head in the conveyance direction to the nip of the first discharge member is less than the maximum length of the recording medium usable in the image forming apparatus in the conveyance direction.

15. The image forming apparatus according to claim 1, wherein in a case that a portion of the recording medium reaches the nip of the first discharge member, the portion of the recording medium is not pulled by the first discharge member.

16. The image forming apparatus according to claim 1, wherein the first discharge member is configured to apply against the recording medium a contact pressure that does not pull a portion of the recording medium which has passed through the curved portion of the conveyance path.

* * * * *